US009808665B1

(12) United States Patent
Demarais et al.

(10) Patent No.: US 9,808,665 B1
(45) Date of Patent: Nov. 7, 2017

(54) EXERCISE DEVICE

(71) Applicant: Eternal Evolution LLC, Helena (MT)

(72) Inventors: Chance Michael Demarais, Helena, MT (US); Stephen Sanford, Bozeman, MT (US); Kirk Turner, Bozeman, MT (US); David Yakos, Bozeman, MT (US); Joel Switzer, Belgrade, MT (US)

(73) Assignee: Eternal Evolution LLC, Helena, MT (US)

( * ) Notice: Subject to any disclaimer, the term of this patent is extended or adjusted under 35 U.S.C. 154(b) by 13 days.

(21) Appl. No.: 15/193,019

(22) Filed: Jun. 25, 2016

(51) Int. Cl.

| | |
|---|---|
| ***A63B 5/20*** | (2006.01) |
| ***A63B 21/00*** | (2006.01) |
| ***A63B 23/02*** | (2006.01) |
| ***A63B 22/20*** | (2006.01) |
| ***A61H 15/00*** | (2006.01) |

(52) U.S. Cl.
CPC ..... *A63B 21/4035* (2015.10); *A61H 15/0092* (2013.01); *A63B 5/20* (2013.01); *A63B 22/20* (2013.01); *A63B 23/02* (2013.01); *A61H 2015/0014* (2013.01)

(58) Field of Classification Search
CPC ..... A63B 21/0004; A63B 21/4035; A63B 23/1236; A63B 22/20; A63B 23/02; A63B 5/20; A61H 15/009; A61H 2015/0014
USPC ..... 482/13, 14, 47, 51, 92, 131, 132, 139, 482/141
See application file for complete search history.

(56) References Cited

U.S. PATENT DOCUMENTS

| | | | | | |
|---|---|---|---|---|---|
| 285,476 | A * | 9/1883 | Frink | F28F 5/02 | 165/89 |
| 1,247,162 | A * | 11/1917 | Southwick | A21C 3/021 | 492/14 |
| 3,831,238 | A * | 8/1974 | Adams | A21C 3/021 | 492/14 |
| 4,179,119 | A * | 12/1979 | Wolf | A63B 5/20 | 482/82 |
| 4,314,395 | A * | 2/1982 | Brock | B44C 7/06 | 15/230.11 |
| 4,334,445 | A * | 6/1982 | Timewell | B25B 13/481 | 81/177.7 |
| 4,618,142 | A * | 10/1986 | Joseph, Jr. | A63B 5/20 | 482/106 |
| 4,639,961 | A * | 2/1987 | Chasan | A47C 27/085 | 5/673 |

(Continued)

*Primary Examiner* — Stephen R Crow
*Assistant Examiner* — Garrett Atkinson
(74) *Attorney, Agent, or Firm* — Antoinette M. Tease

(57) ABSTRACT

A portable exercise device with a cylindrical and elongated main shaft and a plurality of central components that fit over the main shaft. Both ends of the main shaft are releasably attached handles. Each of the handles comprises a grip section that is cylindrical in shape and overlies a handle support. The grip section of each of the handles is releasably attached to the handle support, and the handle supports are releasably attached to the main shaft. Longitudinal axes of the main shaft and handles are collinear. Each of the handles comprises an attachment member that extends from a distal end of the handle and forms an arc. An inner circumference of the attachment member is circular except for a flat portion that is equal in width to the flat portion of the handle support. The handle attachment members are configured to releasably attach to the handle supports.

13 Claims, 14 Drawing Sheets

(56) References Cited

U.S. PATENT DOCUMENTS 4,712,539 A * 12/1987 Kim ..... A61H 15/0092 601/120
4,862,542 A * 9/1989 Jordan ..... A47C 21/00 5/673
5,000,671 A * 3/1991 Nolte ..... B28B 3/12 134/68
5,261,866 A * 11/1993 Mattox ..... A63B 21/0552 482/125
5,300,002 A * 4/1994 Freye ..... A63B 23/03516 482/114
5,364,338 A * 11/1994 Terashima ..... A61H 15/0092 601/118
5,499,961 A * 3/1996 Mattox ..... A63B 21/055 482/123
5,925,077 A * 7/1999 Williamson ..... A61B 17/1666 623/22.34
6,280,369 B1 * 8/2001 Gibran ..... A21C 3/021 492/14
6,638,201 B1 * 10/2003 Dischler ..... A63B 22/20 482/132
7,175,573 B1 * 2/2007 Huang ..... A63B 21/0004 446/236
7,291,101 B2 * 11/2007 Deal ..... A61H 15/0092 482/121
7,322,905 B2 * 1/2008 Morris ..... A63B 23/047 482/118
7,387,599 B1 * 6/2008 Hsu ..... A61H 15/0092 482/122
7,404,228 B2 * 7/2008 Hodges ..... B05C 17/0217 15/230.11
7,837,603 B1 * 11/2010 Carnell, Sr. ..... A63B 21/0004 482/132
7,922,634 B1 * 4/2011 Wu ..... A63B 21/0004 482/121
8,137,251 B2 * 3/2012 Tozzi ..... A63B 22/203 482/132
8,784,287 B2 7/2014 Miller, Jr.
8,894,555 B2 11/2014 Colledge et al.
8,926,482 B2 1/2015 Miller, Jr.
2002/0111256 A1 * 8/2002 Tuller ..... A63B 21/026 482/140
2003/0050153 A1 * 3/2003 Stevens ..... A63B 21/025 482/92
2003/0134726 A1 * 7/2003 Yu ..... A63B 21/00043 482/110
2003/0158023 A1 * 8/2003 Yu ..... A63B 21/0004 482/126
2004/0040111 A1 * 3/2004 Er ..... B05C 17/0217 15/230.11
2005/0202944 A1 * 9/2005 Deal ..... A61H 15/0092 482/126
2008/0167168 A1 * 7/2008 Hurst ..... A63B 21/0728 482/132
2009/0064436 A1 * 3/2009 Scott, Sr. ..... B05C 17/0217 15/230.11
2012/0100969 A1 * 4/2012 Brodbeck ..... A63B 22/20 482/132
2012/0309599 A1 * 12/2012 Miller, Jr. ..... A63B 22/20 482/139
2013/0017936 A1 * 1/2013 Olson ..... A63B 21/0004 482/132
2013/0095984 A1 * 4/2013 Agate ..... A63B 21/0618 482/106
2013/0310234 A1 11/2013 Miller, Jr.
2014/0349821 A1 11/2014 Davis

* cited by examiner

EXERCISE DEVICE

BACKGROUND OF THE INVENTION

1. Field of the Invention

The present invention relates generally to the field of exercise devices, and more particularly, to a portable exercise device that can be used as an abdominal roller, massage tool and jump rope.

2. Description of the Related Art

The health and physical fitness industry has failed to provide a significant spectrum of consumers with a simple, portable, effective, efficient, customizable and comprehensive approach to health and wellness. Instead of implementing simple-to-use and simple-to-understand products designed to target a broad range of persons regardless of ability or inability, the health, wellness and fitness industries have inadvertently hampered the fluid evolution of human physical fitness. By prioritizing the aesthetics of exercising and working out rather than the gains in self-esteem and overall health that are achieved through exercise, the health and physical fitness sector actively alienates a large number of individuals that would otherwise benefit tremendously from exercise.

Regular physical activity has been proven repeatedly to reduce significantly an individual's risk of developing eight out of the ten leading causes of death in the United States [References 1, 2 and 3]. Furthermore, it is has been shown to actively delay the onset of debilitating symptoms associated with these same causes of death [References 1, 2 and 3]. Despite these facts, the health and physical fitness industry has failed to provide a simple, portable, effective, efficient, customizable and comprehensive product approach capable of benefitting individuals of all ages and abilities (beginner to expert).

In recent years, due to the growing number of issues related to poor health, the U.S. government has introduced a number of exercise guidelines and recommendations. Nonetheless, 78-81% of U.S. adults fail to reach the recommended amount of daily, physical activity [Reference 4]. The reasons for lack of exercise include: working out is too hard to understand; I am always traveling for work; a gym membership is too expensive; when I work out, I get sore; and exercise products or equipment are too difficult to use [References 5 and 6].

The present invention solves these problems by providing an exercise system that is encompassed within a single, portable device that is easy to assemble and intuitive to the user. It is also highly efficient, effective and comprehensive (in terms of being able to exercise and provide a system of recovery for the totality of the human body). The present invention is a vastly compact and customizable workout/exercise device. The compact and interchangeable design allows people to exercise virtually anywhere, and the device enables users to engage in a combination of exercises, warm-up methods and recovery techniques.

The present invention is specifically designed to provide customizable full body workouts as well as trigger point massage functionality to warm up the body and muscles for physical exertion, mitigate soreness, and facilitate the recovery process. The invention includes trigger point massage components for the hands, feet, and major muscle groups of the human body. Massage apparatuses stimulate blood flow before workouts, aid in the alleviation of knots in muscles, improve flexibility, and boost muscle recovery following a workout by actively flushing the lactic acid out of the fatigued muscle tissues.

Although there are exercise devices in the prior art that combine massage capabilities with, for example, an abdominal roller or resistance bands, there is no prior art device that possesses all of the structural features and interchangeability of the present invention. Some of these devices are discussed below.

U.S. Pat. No. 4,618,142 (Joseph, Jr., 1986) provides an exercise device in which a jump rope is mounted to a bar by rigid standoff rods. The device also has means for receiving a selected weight at either end of the bar. The quantity of weight, length of the jump rope, and position of the hand grips on the bar are adjustable by the user.

U.S. Pat. No. 4,712,539 (Kim, 1987) discloses a therapeutic device for applying pressure to various muscles and other parts of the body in which a plurality of disc-shaped rolling elements are rotatably mounted on a shaft between nonrotating handles. In one embodiment, a symmetrically curved rolling element is centrally disposed between smaller disc-shaped rolling elements.

U.S. Pat. No. 7,291,101 (Deal, 2007) involves an exercise device that is comprised of a shaft with one or two rollers that are free to slide on the shaft. The shaft can be straight or bent elastically to form a semi-circle. In one embodiment, the device is comprised of two rollers that are held together by a pair or handles. Optional springs connect the handles to the shaft.

U.S. Pat. No. 7,387,599 (Hsu, 2008) describes a massaging body-gym apparatus that is comprised of a rod, at least two rollers, two positioning sleeves, two sealing covers and an elastic rope. The device functions as an abdominal roller and massage tool but does not function as a jump rope; the elastic rope is used for purposes of providing resistance when the supporting cushion (which is situated in the middle of the elastic rope the ends of which are attached to the rod) is extended away from the rod.

U.S. Pat. No. 7,837,603 (Carnell, Sr., 2010) provides an exercise wheel with a central shaft and counter-locking handles. At least one wheel is mounted on the shaft through a central opening in the wheel. Removable handles are on either end of the shaft. This device is strictly used as an abdominal roller.

U.S. Pat. No. 7,922,634 (Wu, 2011) discloses a pull exerciser comprised of a bar, two handles, and an elastic cord that extends from the bar to provide tension when the cord is extended. The invention further comprises a padding member made of resilient material that is mounted around the connecting portion of the cord mounting section of each of the handles.

U.S. Pat. No. 8,784,287 (Miller, Jr., 2014) and U.S. Pat. No. 8,926,482 (Miller, Jr., 2015) both involve a rolling exercise device that is comprised of an elongate member with a first handle assembly on one end and a second handle assembly on the other end. The handle assemblies function as wheels on either side of the elongate member. They can also be removed and joined together to form a second configuration that does not include the elongate member.

U.S. Pat. No. 8,894,555 (Colledge et al., 2014) describes a hand-held exercise device that works the arms, abdomen and core muscles. The device is comprised of first and second handles that rotate about a central axis relative to one another and a wheel that also rotates about the central axis. The device is configured to apply resistance to the relative rotation of the handles and the rotation of the wheel via adjustment knobs. The device also includes a stretchable band and an optional pad.

U.S. Patent Application Pub. No. 20140349821 (Davis) provides an exercise system or kit that is comprised of a cylindrical body, an elongated bar, and one or more resistance bands that can be coupled to the bar. The cylindrical body has a bore that extends longitudinally through the center of the body and a centrally situated annular groove that extends around the circumference of the cylindrical body. The dimensions of the bar, the groove and the bore are such that the bar can be inserted into and through the bore and also positioned within the annular groove.

BRIEF SUMMARY OF THE INVENTION

The present invention is a portable exercise device comprising: a cylindrical and elongated main shaft with a first end and a second end; and a plurality of central components that fit over the main shaft, each of the plurality of central components comprising a central bore through which the main shaft extends; wherein the first end of the main shaft is releasably attached to a first handle, and the second end of the main shaft is releasably attached to a second handle; wherein each of the first and second handles comprises a grip section that is cylindrical in shape and that overlies a handle support with a flat portion; wherein the grip section of each of the first and second handles is releasably attached to the handle support; wherein the handle supports are releasably attached to the main shaft; wherein the main shaft has a longitudinal axis, the first and second handles each has a longitudinal axis, and the longitudinal axes of the main shaft and handles are collinear; wherein each of the first and second handles comprises an attachment member that extends from a distal end of the handle along the longitudinal axis of the handle and forms an arc; wherein an inner circumference of the attachment member is circular except for a flat portion that is equal in width to the flat portion of the handle support, and wherein the flat portion of the inner circumference of the attachment member is situated between the grip section of the handle and a top end of the arc formed by the attachment member; and wherein the attachment members of the handles are configured to releasably attach to the handle supports.

In one embodiment, the plurality of central components are smooth rollers. In another embodiment, the plurality of central components are trigger point massage rollers having outwardly extending protrusions. In an alternate embodiment, the plurality of central components includes at least one wheel.

In a preferred embodiment, the grip section of each of the first and second handles is covered by a rubber material. Preferably, the grip section and attachment member of each of the first and second handles are manufactured from a single piece of metal. In another preferred embodiment, the main shaft has a main section with an outer diameter, and the main shaft comprises a protrusion on either end of the main shaft, the protrusion having an outer diameter that is less than an outer diameter of the main section of the main shaft.

In a preferred embodiment, the flat portion of the handle support extends from a distal end of the handle support to a point that terminates short of a proximal end of the handle support. Preferably, the flat portion of the handle support comprises a plurality of holes that are aligned along a longitudinal axis of the handle support.

The invention preferably further comprises a first foot pad and a second foot pad; wherein each of the first and second foot pads is releasably attached to the handle support; wherein each of the first and second foot pads comprises a base plate and a strap that is attached to the base plate and that is configured to allow a person to insert his or her foot between the strap and the base plate; wherein each of the first and second foot pads further comprises an attachment member that extends outwardly from a bottom surface of the base plate and forms an arc; and wherein an inner circumference of the foot pad attachment member is circular except for a flat portion that is equal in width to the flat portion of the handle support. The strap preferably extends from left to right of the foot pad and is situated closer to a bottom end of the foot pad than a top end.

In a preferred embodiment, the invention further comprises a jump rope assembly that is releasably attached to the handle support; wherein the jump rope assembly comprises a housing an insert member that is attached to an inner wall of the housing;

wherein the insert member is arc-shaped except for a flat portion; wherein there is a gap between an outer surface of the insert member opposite the flat portion and an underside of a ceiling of the housing, and wherein the gap is configured to enclose at least a portion of the attachment member of the handle; wherein the insert member is releasably attached to the attachment member of the handle; wherein a cable housing is attached to an outer surface of the ceiling of the housing and is configured to accept and secure a jump rope cable; and wherein the jump rope cable is configured to rotate within the relative to the outer surface of the ceiling of the housing.

The present invention is also a portable exercise device comprising: a cylindrical and elongated main shaft with a first end and a second end; and a plurality of central components that fit over the main shaft, each of the plurality of central components comprising a central bore through which the main shaft extends; wherein the first end of the main shaft is releasably attached to a first handle, and the second end of the main shaft is releasably attached to a second handle; wherein each of the first and second handles comprises a grip section that is cylindrical in shape and that overlies a handle support; wherein the grip section of each of the first and second handles is releasably attached to the handle support; wherein the handle supports are releasably attached to the main shaft; wherein the main shaft has a longitudinal axis, the first and second handles each has a longitudinal axis, and the longitudinal axes of the main shaft and handles are collinear; wherein each of the first and second handles comprises an attachment member that extends from a distal end of the handle along the longitudinal axis of the handle and forms an arc; wherein an inner circumference of the attachment member is circular; and wherein the attachment members of the handles are configured to releasably attach to the handle supports.

REFERENCE NUMBERS

Figure 1:
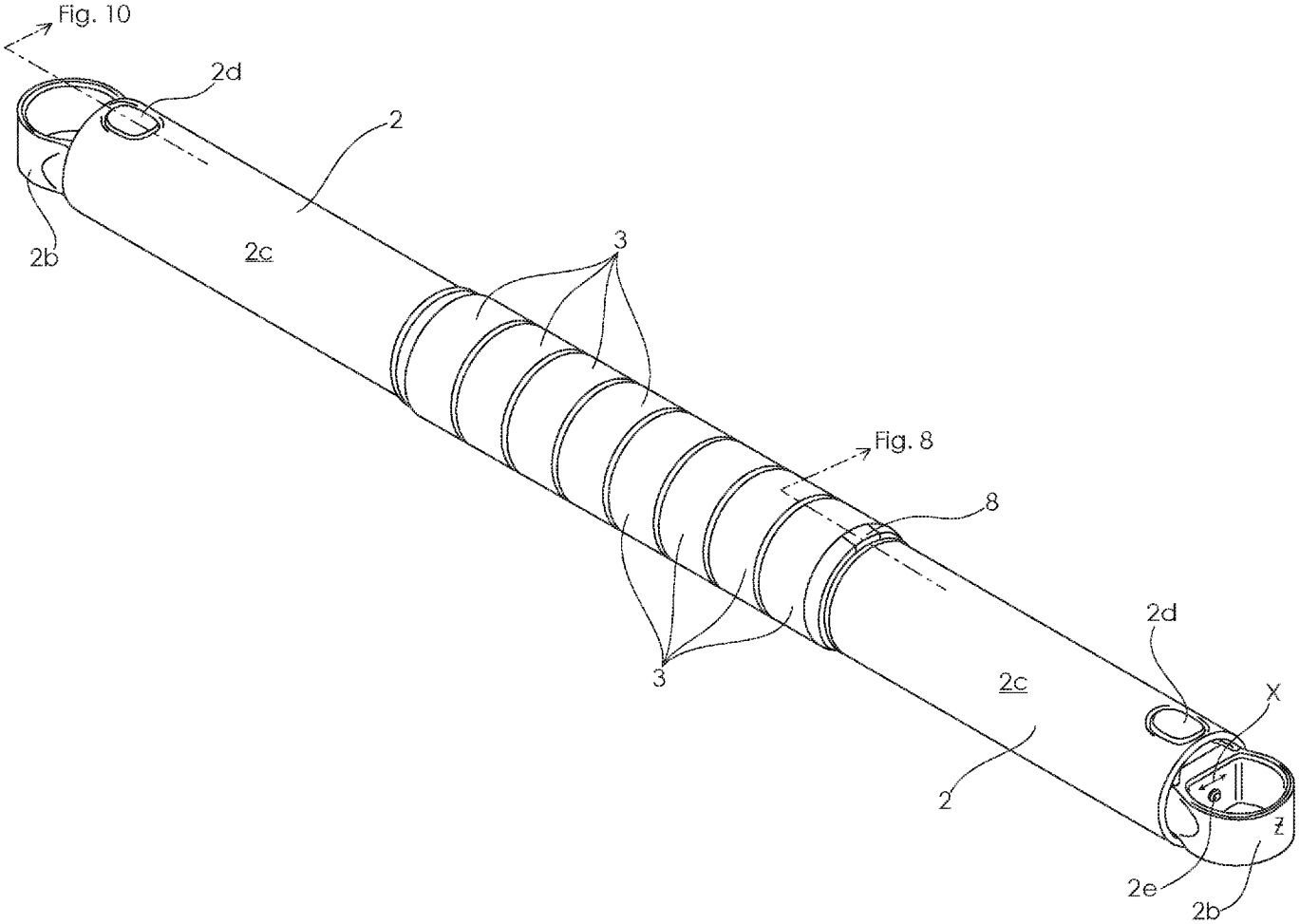
FIG. 1 is a perspective view of the present invention shown with smooth rollers only.

1 Main shaft
1*a* Protrusion (main shaft)
2 Handle
2*a* Grip section (of handle)
2*b* Attachment member (of handle)
2*c* Rubber material (around grip section of handle)
2*d* Handle release button
2*e* Button (on first end of rocker spring)
2*f* Button (on second end of rocker spring)
3 Smooth roller
4 Trigger point massage roller
5 Wheel
6 Handle support
6*a* Flat portion (of handle support)
6*b* Holes (in flat portion of handle support)
6*c* Inner wall (proximal end of handle support)
7 Foot pad
7*a* Base plate (of foot pad)
7*b* Strap (of foot pad)
7*c* Attachment member (of foot pad)
7*d* Foot pad release button
7*e* Button (on spring 11)
8 Handle support release button
9 Leaf spring (of handle support release)
9*a* Button (on leaf spring)
10 Rocker spring
11 Leaf spring (of foot pad release)
12 Jump rope assembly
12*a* Housing (of jump rope assembly)
12*b* Insert member (of jump rope assembly)
12*c* Flat portion (of insert member)
12*d* Hole (in flat portion 12*c*)
12*e* Cable housing
13 Jump rope cable
13*a* End cap

DETAILED DESCRIPTION OF INVENTION

FIG. 1 is a perspective view of the present invention shown with smooth rollers only. The invention comprises a cylindrical, elongated main shaft 1 (see FIG. 2) on which are positioned one or more central components (that is, components that are situated between the two handles 2). In the configuration shown in FIG. 1, the central components include a plurality of smooth rollers 3. In other configurations, these central components may include trigger point massage rollers 4 and wheels 5.

Each end of the main shaft 1 is releasably attached to a handle 2. Each handle 2 comprises a grip section 2*a* (see FIG. 8) that is preferably cylindrical in shape and that overlies a handle support 6 (see FIG. 4); the grip section 2*a* is preferably covered by a rubber material 2*c*. Each handle 2 also comprises an attachment member 2*b*. In a preferred embodiment, the grip section 2*a* and attachment member 2*b* are manufactured from a single piece of metal.

The longitudinal axes of the main shaft and handles are collinear. The attachment member 2*b* extends from the distal end of the handle 2 (along the longitudinal axis of the grip section 2*a*) and is preferably arc-shaped. The inner circumference of the attachment member 2*b* is preferably circular except for a flat portion that is of the same width (see "X" on FIG. 1) as the flat portion of the handle support 6 (see "Y" on FIG. 4). The flat portion of the inner circumference of the attachment member 2*b* is situated between the grip section 2*a* of the handle 2 and the top (outer) end of the arc (denoted with a "Z" on FIG. 1).

Figure 2:
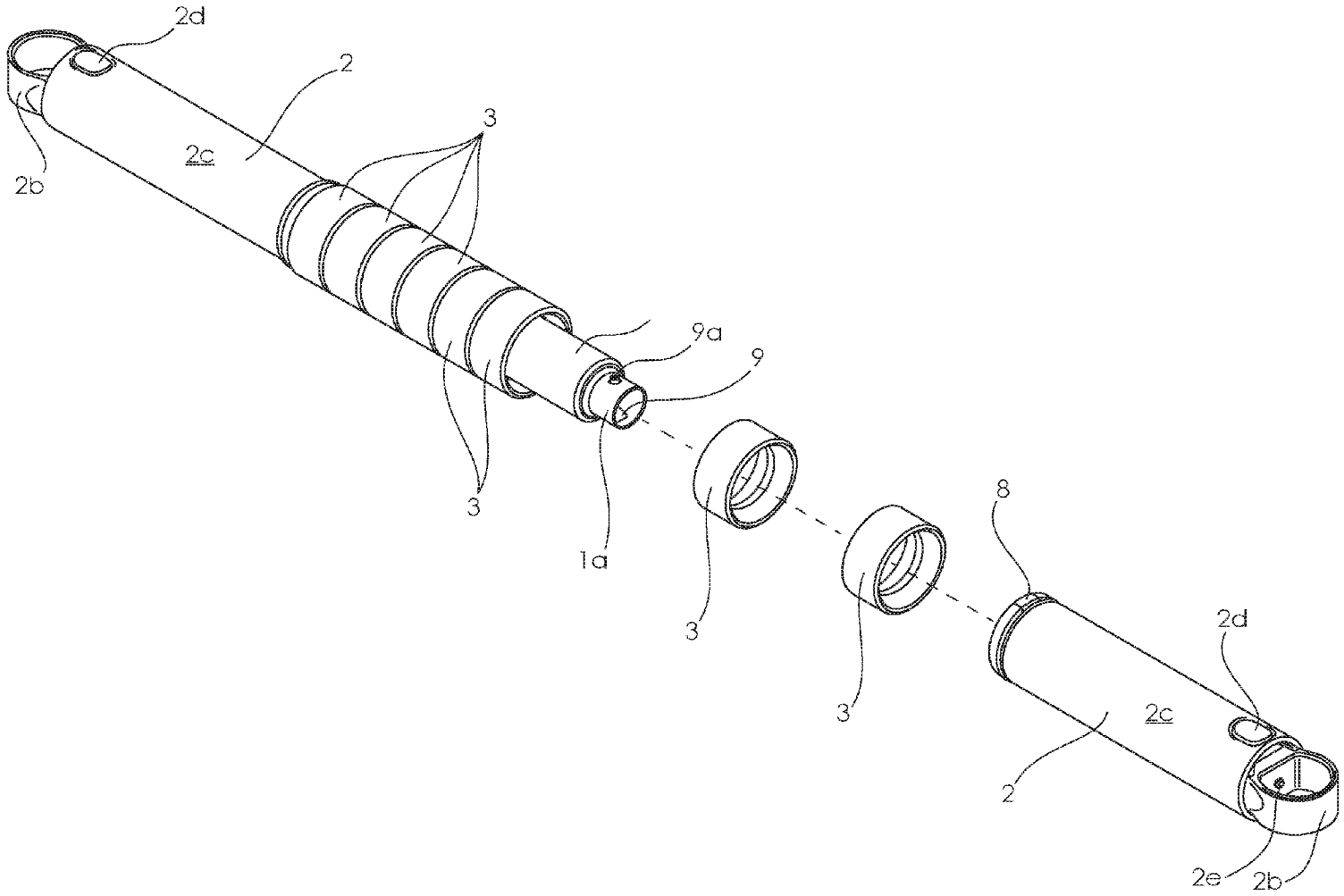
FIG. 2 is a perspective view of the configuration shown in FIG. 1 with one of the handles detached from the main shaft.
Figure 8:
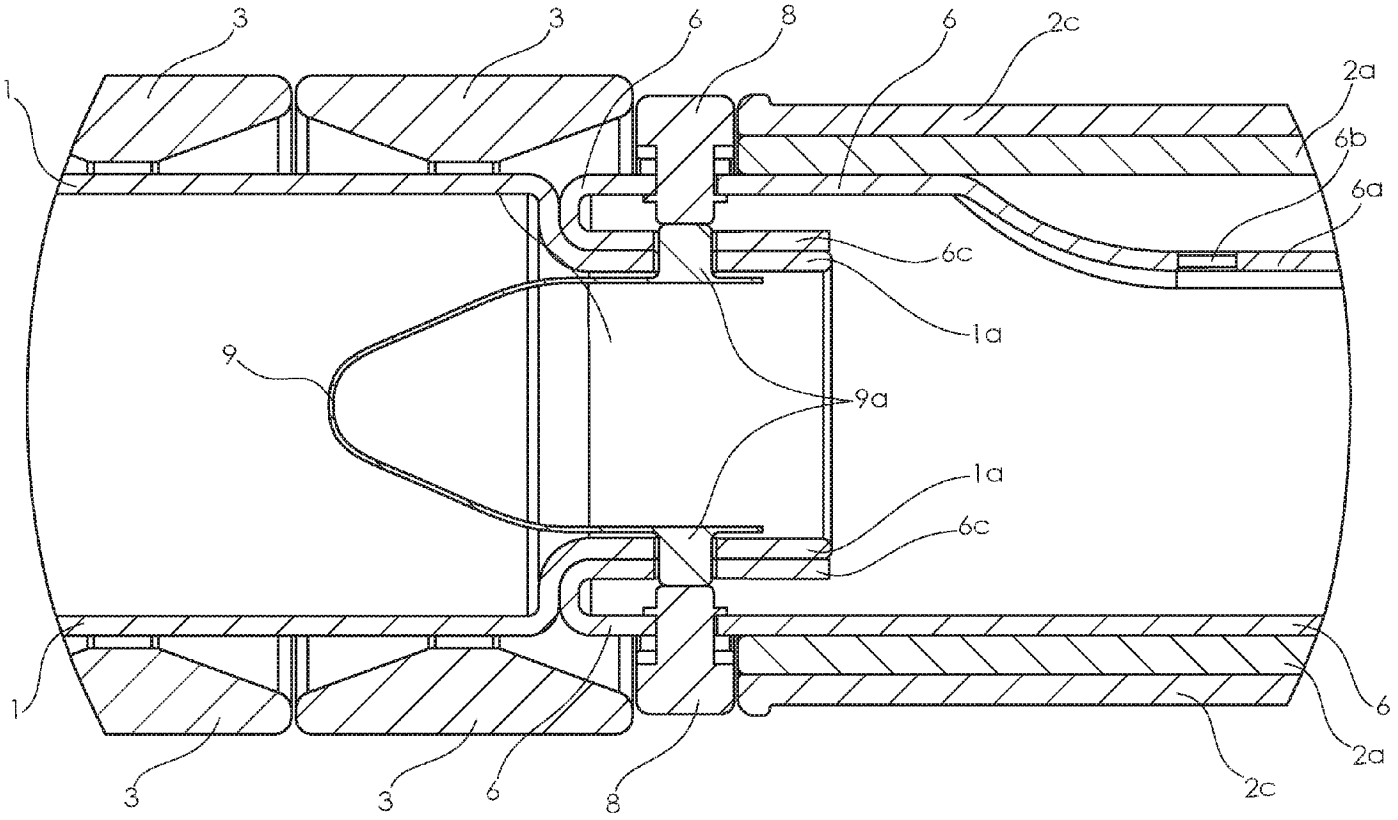
FIG. 8 is a section view of the main shaft release taken at the section line shown in FIG. 4.

FIG. 2 is a perspective view of the configuration shown in FIG. 1 with one of the handles detached from the main shaft. This figure shows the main shaft 1, the leaf spring 9, and the leaf spring button 9*a*. Note that the main shaft 1 comprises a protrusion 1*a* with an outer diameter that is less than the outer diameter of the rest of the main shaft 1 (this is also shown in FIG. 8).

Figure 3:
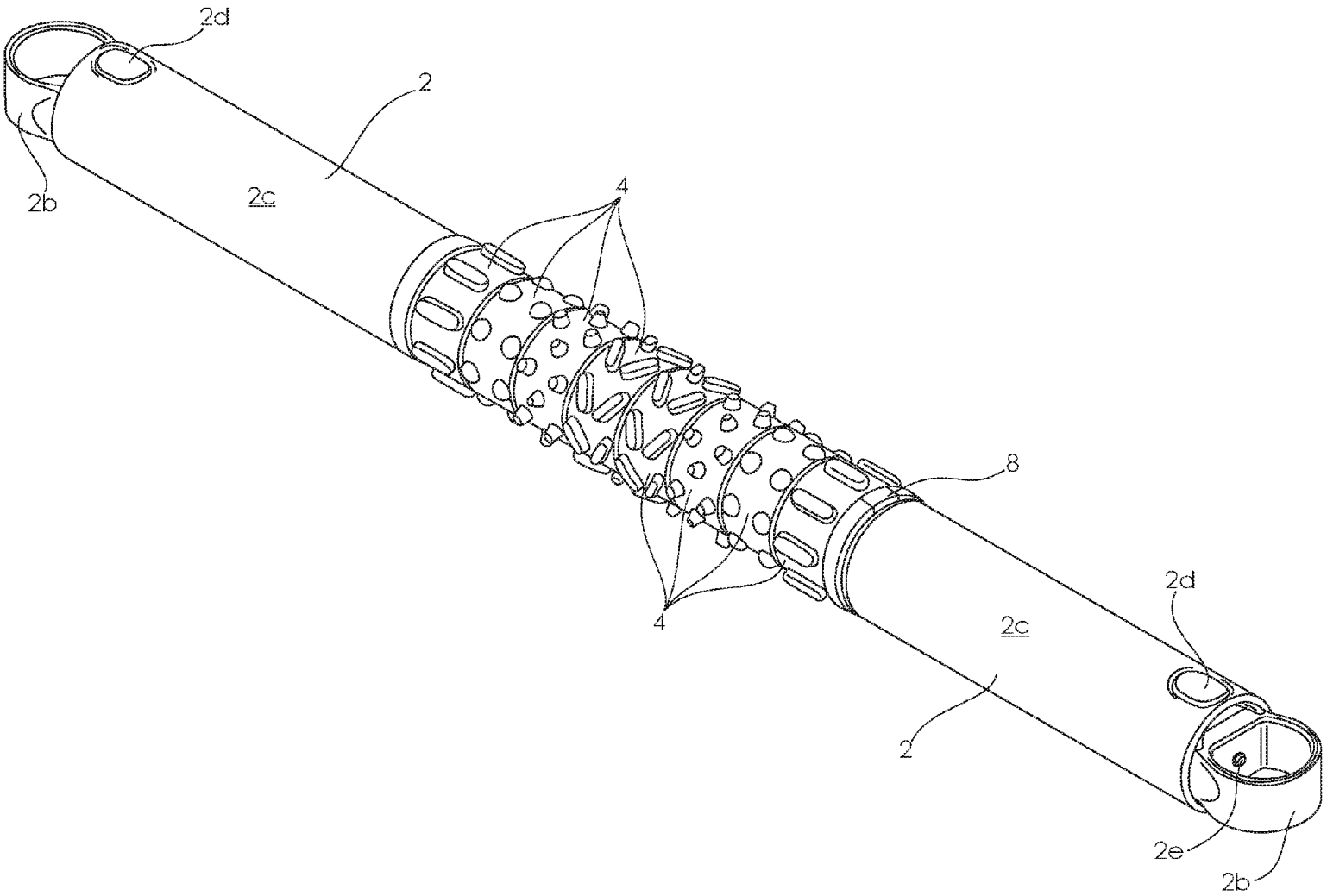
FIG. 3 is a perspective view of the present inventions shown with trigger point massage rollers.

FIG. 3 is a perspective view of the present inventions shown with trigger point massage rollers. As shown in this figure, the smooth rollers shown in FIG. 1 can be replaced with trigger point massage rollers that have outwardly extending protrusions of various shapes and sizes. To replace the smooth rollers 3 with trigger point massage rollers 4 (or vice versa), one of the handle supports 6 (see FIG. 4) is released from the main shaft 1, the undesired rollers are replaced with the desired rollers, and the handle support 6 is reconnected to the main shaft. (This can be done without releasing the handle grip section 2*a* of the handle 2 from the handle support 6.) The mechanism by which the handle support 6 is released from the main shaft 1 is discussed more fully below in connection with FIG. 8.

Figure 4:
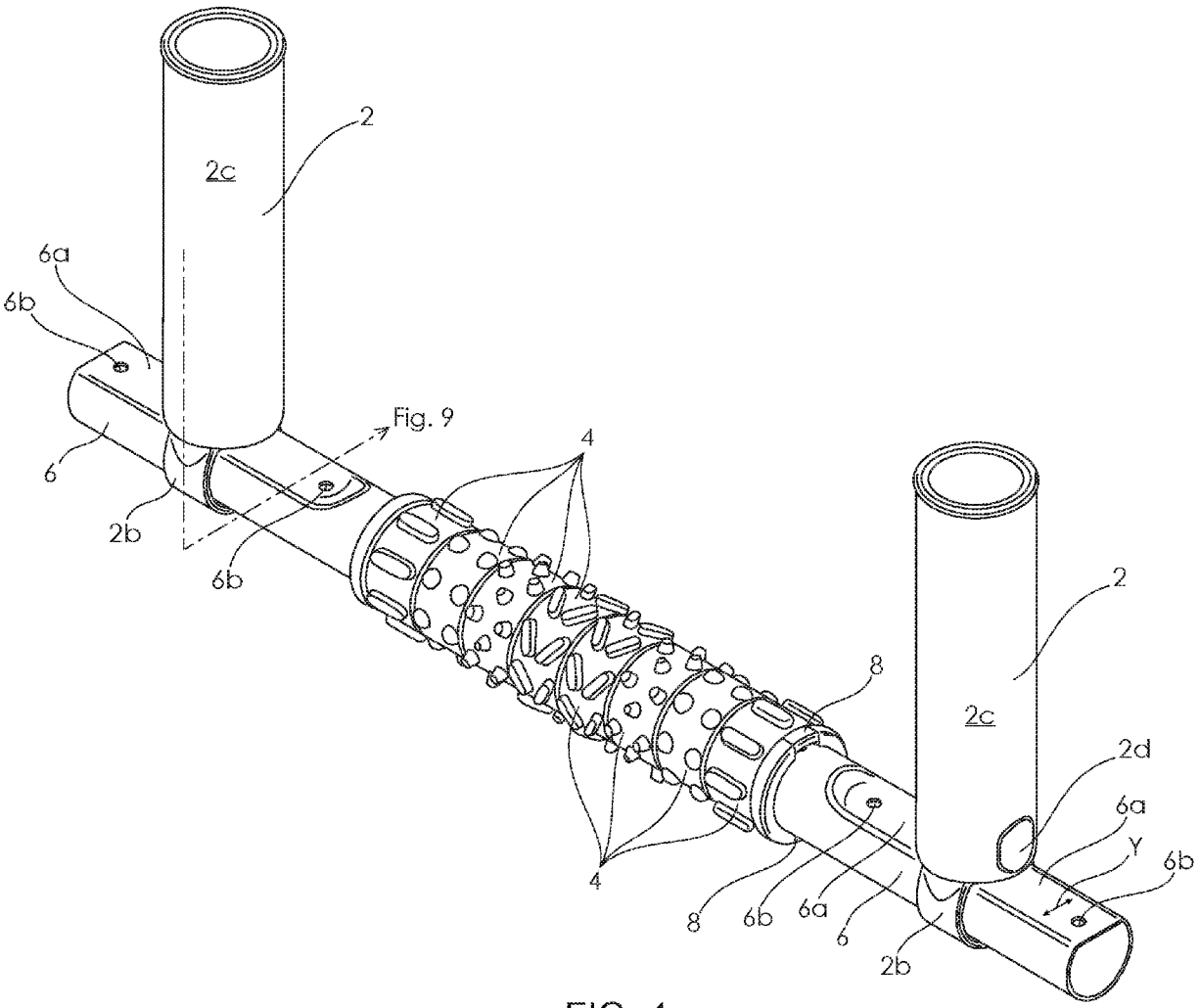
FIG. 4 is a perspective view of the present invention shown with the handles in a perpendicular configuration relative to the handle supports.

FIG. 4 is a perspective view of the present invention shown with the handles in a perpendicular configuration relative to the handle supports. In this configuration, the grip section 2*a* of each of the handles 2 has been released from the handle support 6, and the attachment member 2*b* has been positioned around the outer perimeter of the handle support 6. Note that the handle support is generally cylindrical in shape with a flat portion 6*a* that extends from the distal end of the handle support 6 to a point that terminates short of the proximal end of the handle support 6 (so that the proximal end of the handle support 6 is completely cylindrical). The flat portion 6*a* preferably comprises a plurality of holes 6*b* that are aligned along the longitudinal axis of the handle support 6. These holes 6*b* are used to secure and release the attachment member 2*b* to the handle support 6, as discussed below in connection with FIG. 9. The mechanism by which the grip section 2*a* of the handle 2 is released from the handle support 6 is discussed more fully below in connection with FIG. 10.

Figure 5:
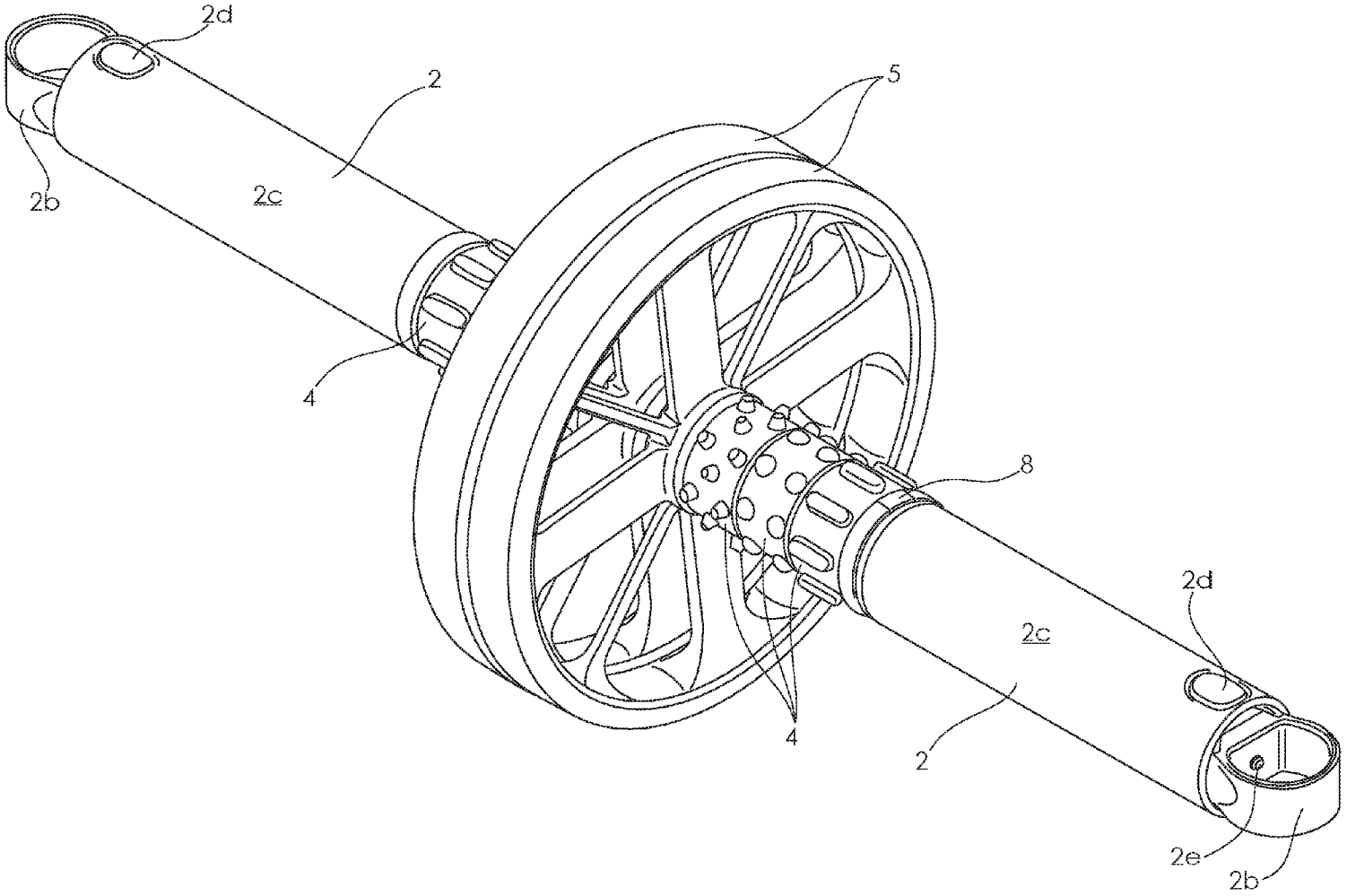
FIG. 5 is a perspective view of the present invention shown with two wheels in the center of the device and the handles in an in-line configuration.

FIG. 5 is a perspective view of the present invention shown with two wheels in the center of the device and the handles in an in-line configuration. In this configuration, two of the smooth rollers 2 have been replaced with wheels 5. Note that the main shaft 1 extends through a central bore in the wheels 5 (just as the main shaft extends through a central bore in each of the rollers). The user may include any combination or configuration of central components on the main shaft. For example, the spacing between the wheels 5 may be increased or decreased by including or eliminating rollers between the wheels.

Figure 6:
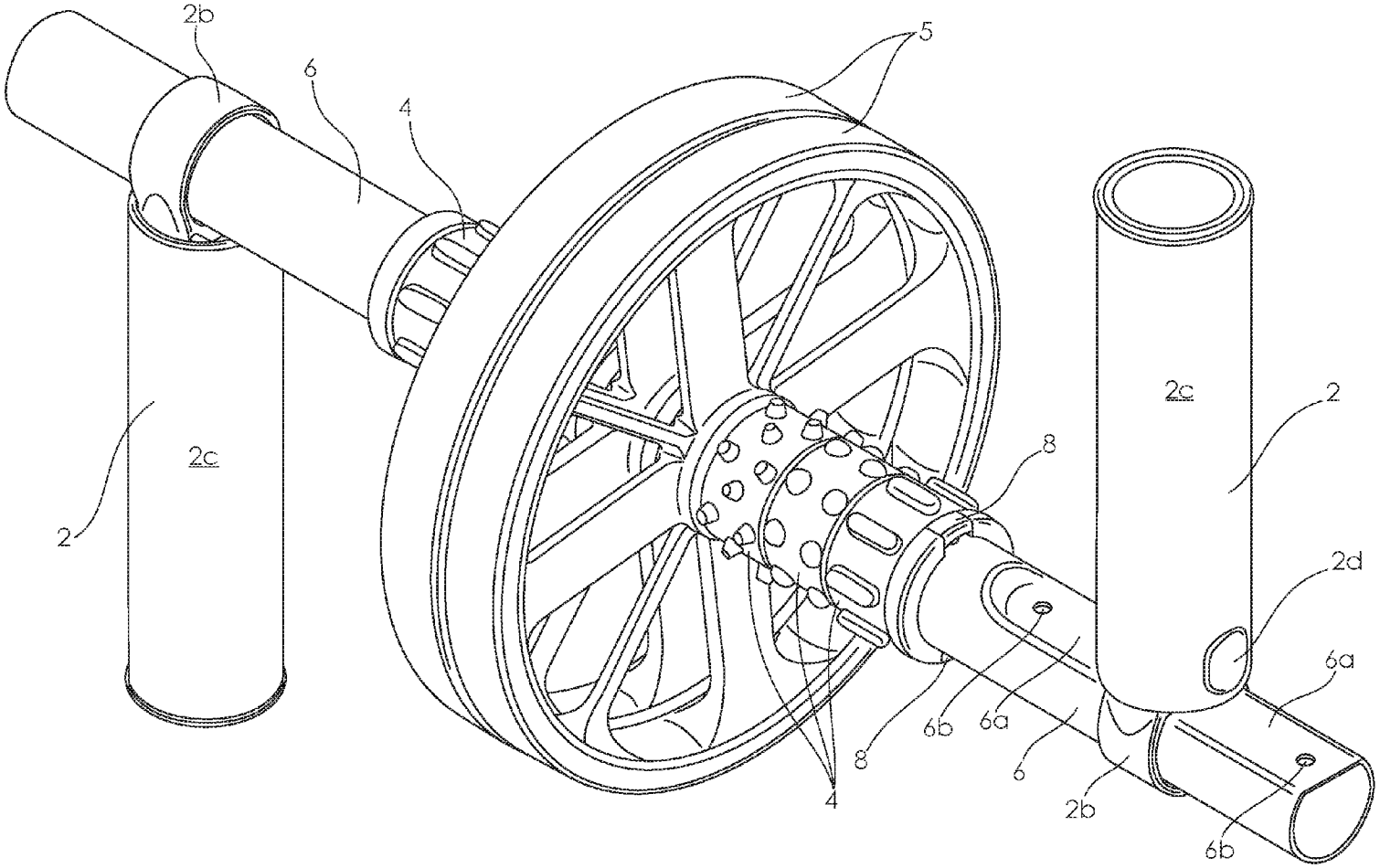
FIG. 6 is a perspective view of the present invention shown with two wheels in the center of the device and the handles in opposing perpendicular configurations.

FIG. 6 is a perspective view of the present invention shown with two wheels in the center of the device and the handles in opposing perpendicular configurations. In this configuration, starting from the configuration shown in FIG. 5, the grip section 2*a* of each handle 2 has been released from the handle support 6, and one of the handle supports 6 has been released from the main shaft 1, rotated one hundred and eighty degrees (180°), and reattached to the main shaft. Next, the attachment member 2*b* of each handle 2 has been positioned over a handle support 6 so that the flat portion of the inner circumference of the attachment member 2*b* lies flat against the flat portion of the handle support 6. Note that the distance between the handles 2 can be adjusted by moving either or both of the attachment members 2*b* longitudinally along the handle support 6 and reattaching the attachment member 2*b* to the handle support 6 once the flat portion of the inside circumference of the attachment member 2*b* has been positioned over one of the holes 6*b* in the flat portion 6*a* of the handle support 6.

Figure 7:
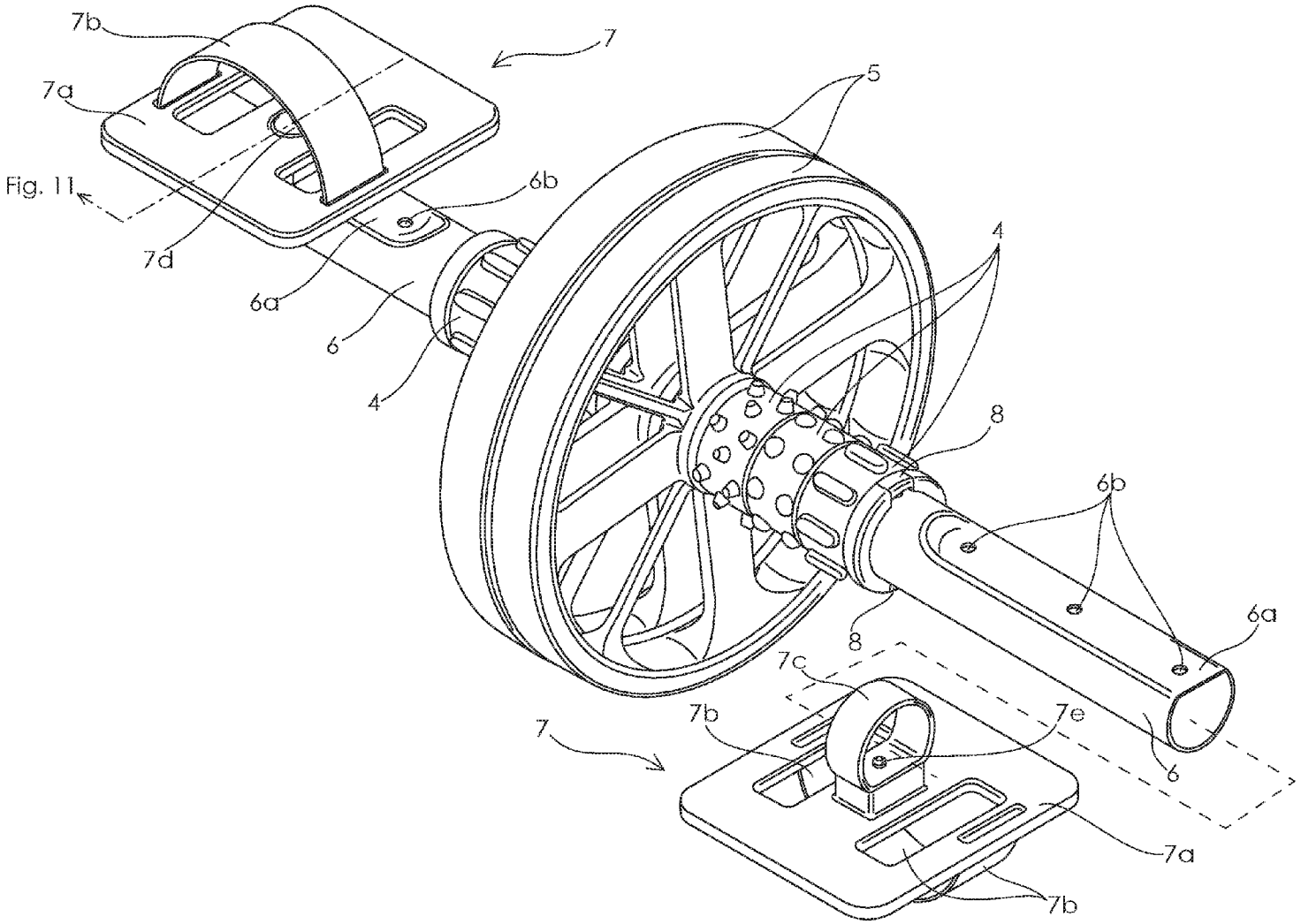
FIG. 7 is a perspective view of the present invention shown with foot pads in lieu of the handles.

FIG. 7 is a perspective view of the present invention shown with foot pads in lieu of the handles. This figure is similar to FIG. 4 except that the handles 2 have been replaced with foot pads 7. Each foot pad 7 comprises a base plate 7*a* and a strap 7*b* that is attached to the base plate 7*a* and configured to allow a person to insert his or her foot between the strap and the base plate. In a preferred embodiment, the strap 7*b* extends from left to right on the foot pad 7 and is situated closer to the bottom end of the foot pad than the top end; this is to facilitate the user inserting his or her foot in between the base plate 7*a* and the strap 7*b* and also to make the foot pad release button 7*d* more accessible (so that it is not placed directly underneath the strap 7*b*).

Each foot pad 7 also comprises an attachment member 7*c* that is similar in structure to the attachment member 2*a* of the handle 2. The attachment member 7*c* extends outwardly from the bottom surface of the base plate 7*a* and is preferably arc-shaped. The inner circumference of the attachment member 7*c* is preferably circular except for a flat portion that is of the same width (see "XX" on FIG. 7) as the flat portion of the handle support 6 (see "Y" on FIG. 4). To insert the foot pad 7 onto the handle support 6, the handle support 6 is inserted through the attachment member 7*c* such that the flat portion of the handle support 6 lies flat against the flat portion of the inner circumference of the attachment member 7*c*. The foot pad release is shown in detail in FIG. 11.

FIG. 8 is a section view of the main shaft release taken at the section line shown in FIG. 1. This figure shows one embodiment of the release between the handle support 6 and the main shaft 1; however, the present invention is not limited to any particular form of main shaft release as long as the handle support 6 is releasably attached to the main shaft 1. In this embodiment, opposing handle support release buttons 8 are situated on the proximal end of the handle support 6. When the handle support release button 8 is pressed, it pushes a button 9*a* on a leaf spring 9, thereby allowing the handle support 6 to be released from the main shaft 1. Note that when the button 9*a* is not compressed, the leaf spring 9 presses the button up into a proximally extending protrusion on the handle support 6, thereby securing the handle support 6 to the main shaft 1. The handle support release button 8 is configured so that it can only be pressed downward by a distance approximately equal to the thickness of an inner wall 6*c* of the proximal end of the handle support 6.

Figure 9:
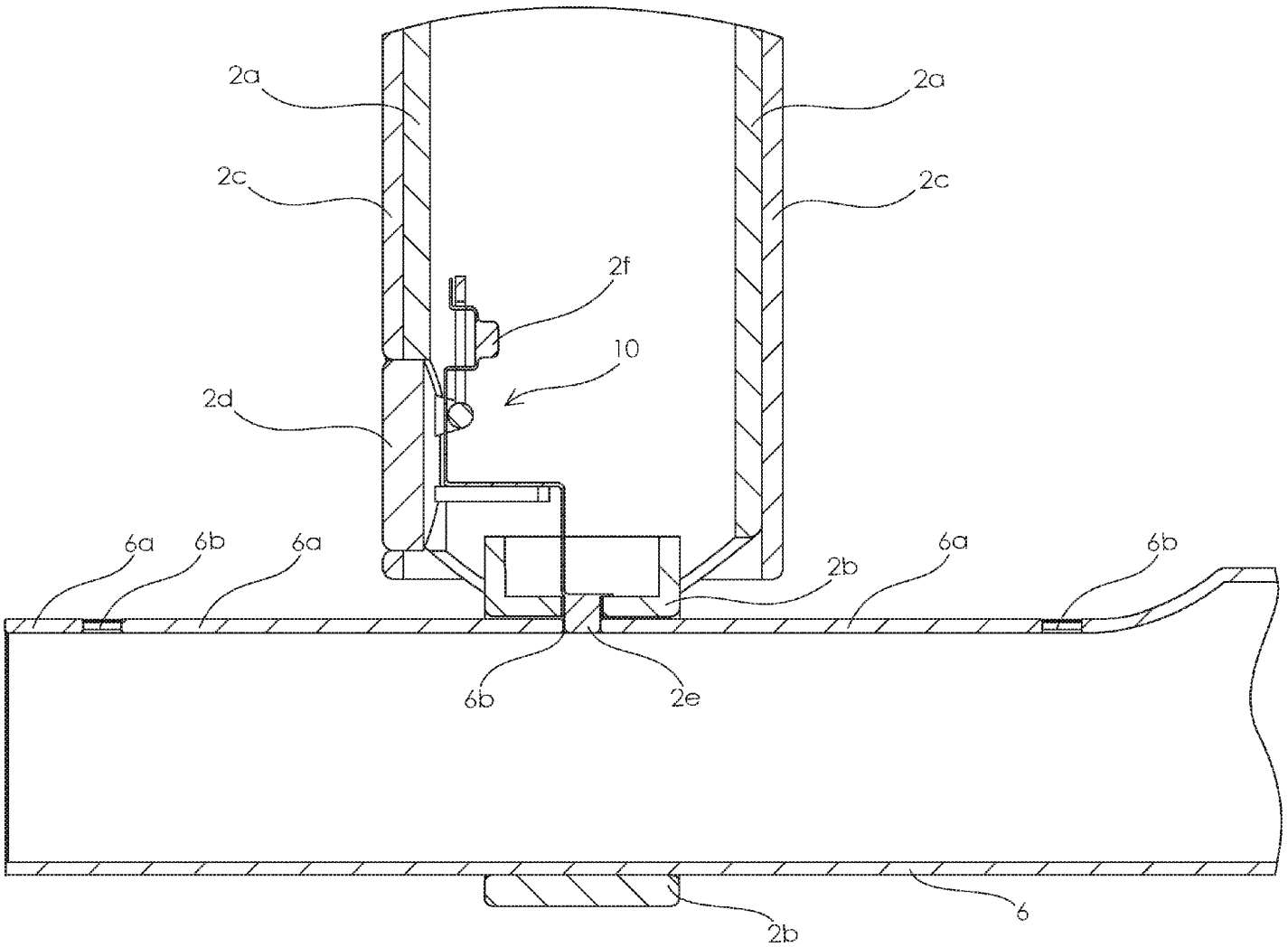
FIG. 9 is a section view of the handle release taken at the section line shown in FIG. 4.

FIG. 9 is a section view of the handle release taken at the section line shown in FIG. 4. As shown in this figure, the handle 2 comprises a handle release button 2*d* that is situated on the proximal end of the handle 2 (that is, the end nearest to the attachment member 2*c*). The release mechanism shown in this figure is one possible embodiment of the handle release, but the present invention is not limited to any particular type of handle release as long as the handle 2 is releasably attached to the handle support 6. In this embodiment, when the handle release button 2*d* is depressed (or pushed inward by the user), a rocker spring 10 causes a button 2*e* on a first end of the rocker spring 10 to move inward (that is, to retreat into the attachment member 2*b*) by a distance roughly equal to the thickness of the wall of the handle support 6. When this happens, the handle 2 can be slid off of the handle support 6. When pressure on the handle release button 2*d* is released, the button 2*e* extends outward again and secures the handle 2 to the handle support 6, as shown. Note that the button 2*e* is configured so that it protrudes from the flat portion of the inner circumference of the attachment member 2*b* (see FIG. 1).

Figure 10:
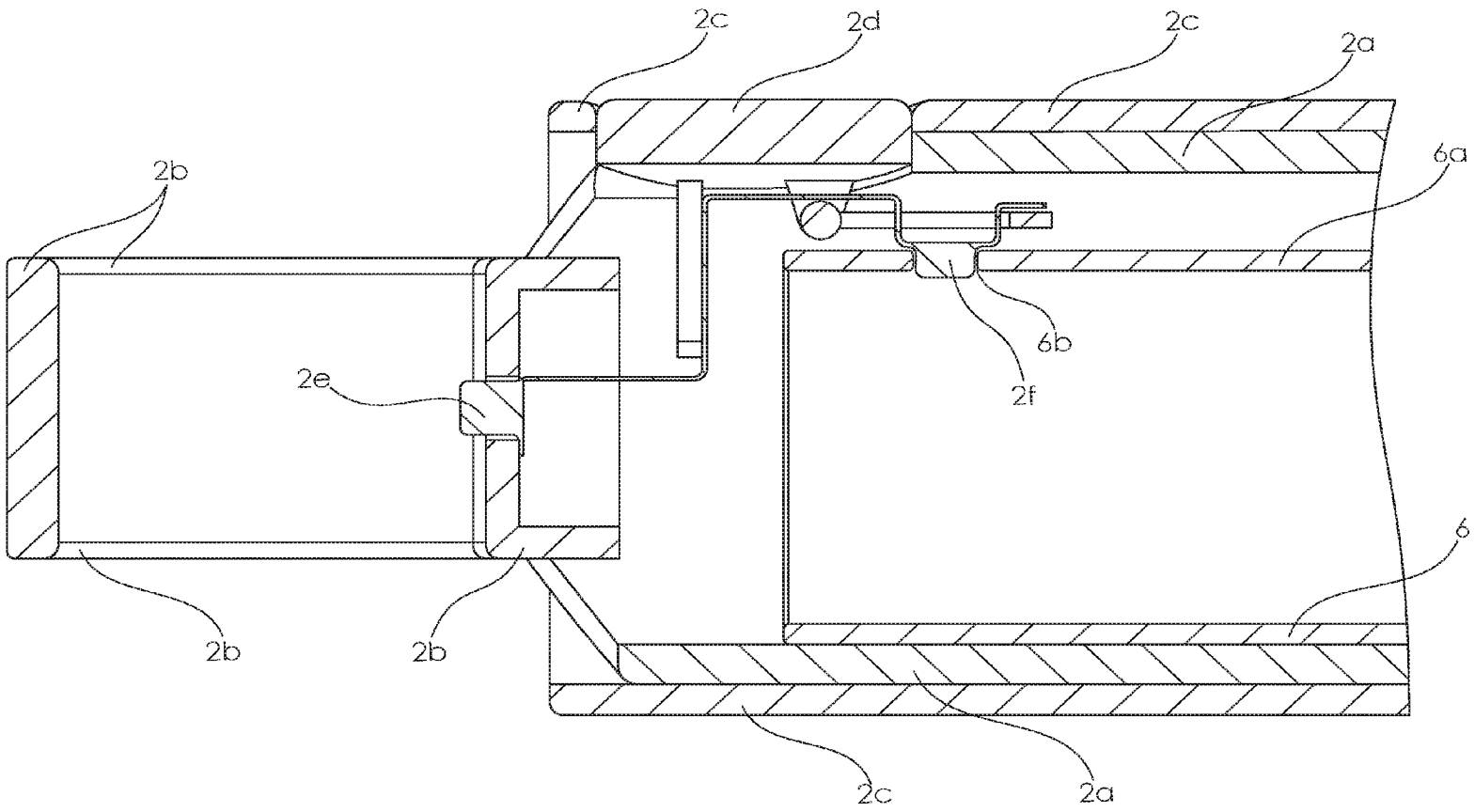
FIG. 10 is a section view of the handle release taken at the section line shown in FIG. 1.

FIG. 10 is a section view of the handle release taken at the section line shown in FIG. 1. As noted above, the present invention is not limited to any particular type of handle release as long as the handle 2 is removably attached to the handle support 6. To release the handle 2 from the handle support 6, the user presses the handle release button 2*d* inward, which action causes a second end of the rocker spring 10 comprising button 2*f* to move outward (that is, away from the flat portion 6*a* of the handle support 6), thereby releasing the handle 2 from the handle support 6. When pressure on the handle release button 2*d* is released, the rocker spring causes the button 2*f* to move back into the hole 6*b* in the flat portion 6*a* of the handle support 6, thereby securing the handle 2 to the handle support 6.

Figure 11:
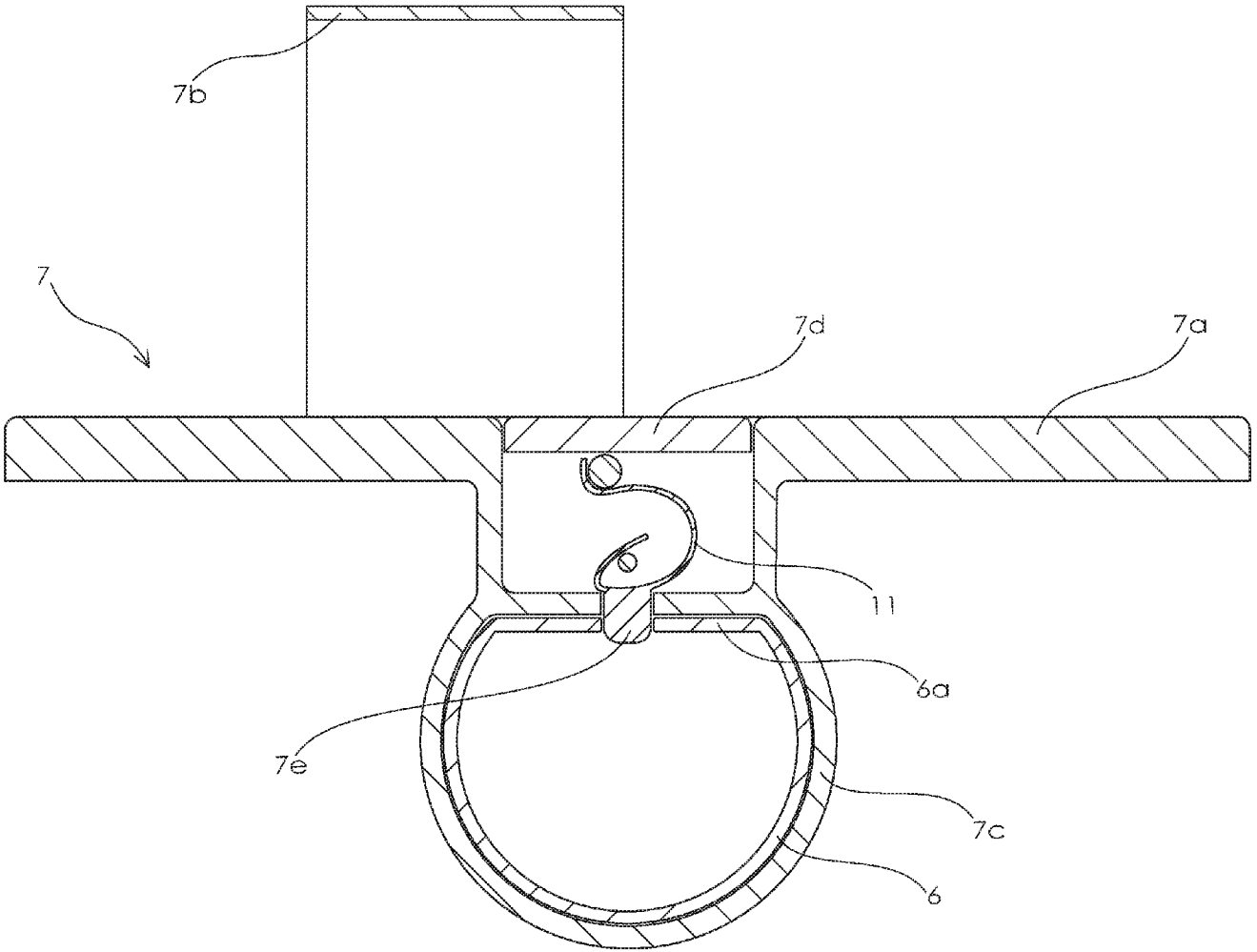
FIG. 11 is a section view of the foot pad release taken at the section line shown in FIG. 7.

FIG. 11 is a section view of the foot pad release taken at the section line shown in FIG. 7. The present invention is not limited to any particular type of foot pad release; however, this figure shows one possible embodiment of this release. As shown in this figure, the foot pad 7 comprises a foot pad release button 7*d* that is preferably centered on the foot pad. When this button is depressed, a spring 11 that is situated between the base plate 7*a* and the attachment member 7*c* causes button 7*e* to retreat inward (that is, away from the flat portion of the inner circumference of the attachment member 7*c*), thereby allowing the foot pad 7 to be slid off of the handle support 6. When pressure on the foot pad release button 7*d* is released, the spring 11 causes the button 7*e* to extend through the flat portion 6*a* of the handle support 6, thereby securing the foot pad 7 to the handle support 6.

Figure 12:
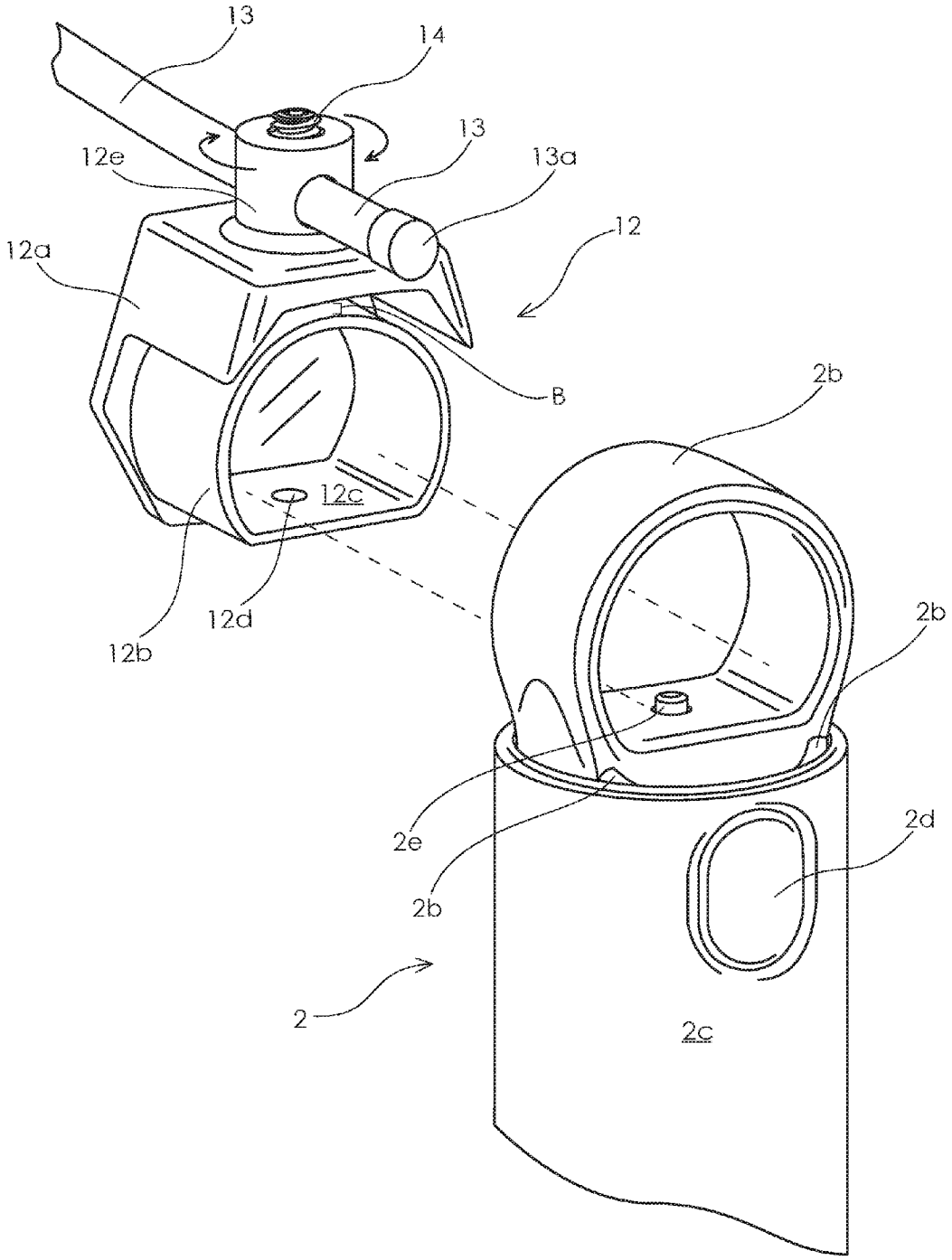
FIG. 12 is a perspective view of the jump rope assembly shown in relation to the distal end of the handle.

FIG. 12 is a perspective view of the jump rope assembly shown in relation to the distal end of the handle. The jump rope assembly 12 comprises a housing 12*a* and an insert member 12*b* that is attached to an inner wall of the housing 12*a*. The insert member 12*b* is generally arc-shaped except for a flat portion 12*c*. Note that there is a gap (labeled as "B" in FIG. 12) between the outer surface of the insert member 12*b* opposite the flat portion 12*c* and the underside of the ceiling of the housing 12*a*; this gap is configured to enclose at least a portion of the arc-shaped attachment member 2*b* of the handle 2. The flat portion 12*c* of the insert member 12*b* comprises a hole 12*d* through which the button 2*e* protrudes (the latter release mechanism has been previously described) when the jump rope assembly 12 is attached to the handle 2. A cable housing 12*e* is attached to the outer surface of the ceiling of the housing 12*a* and is configured to accept and secure a jump rope cable 13. An end cap 13*a* is secured to the end of the jump rope cable 13 to prevent it from sliding out of the cable housing 12*e*.

Figure 13:
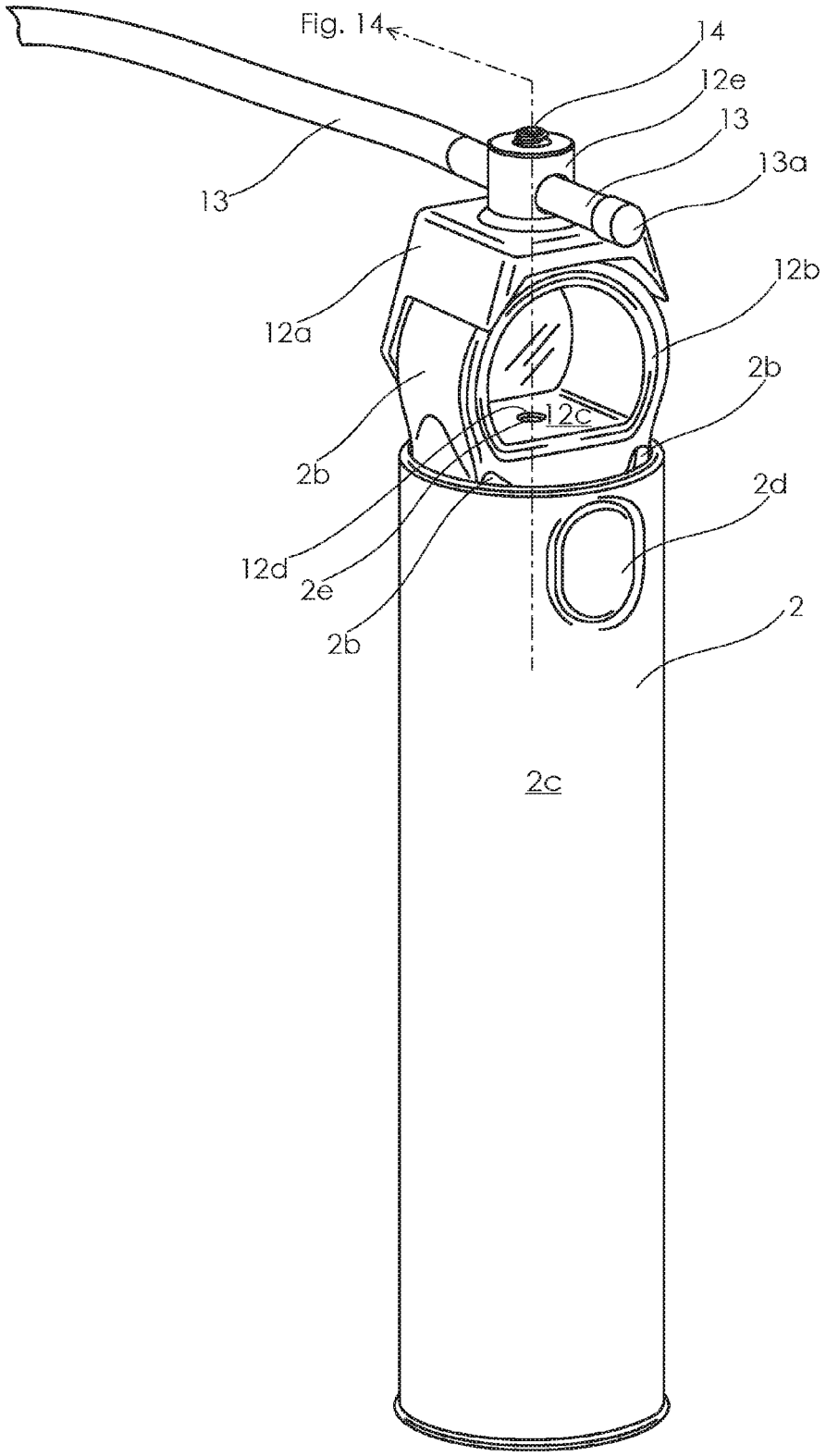
FIG. 13 is a perspective view of the jump rope assembly shown attached to the distal end of the handle.
Figure 14:
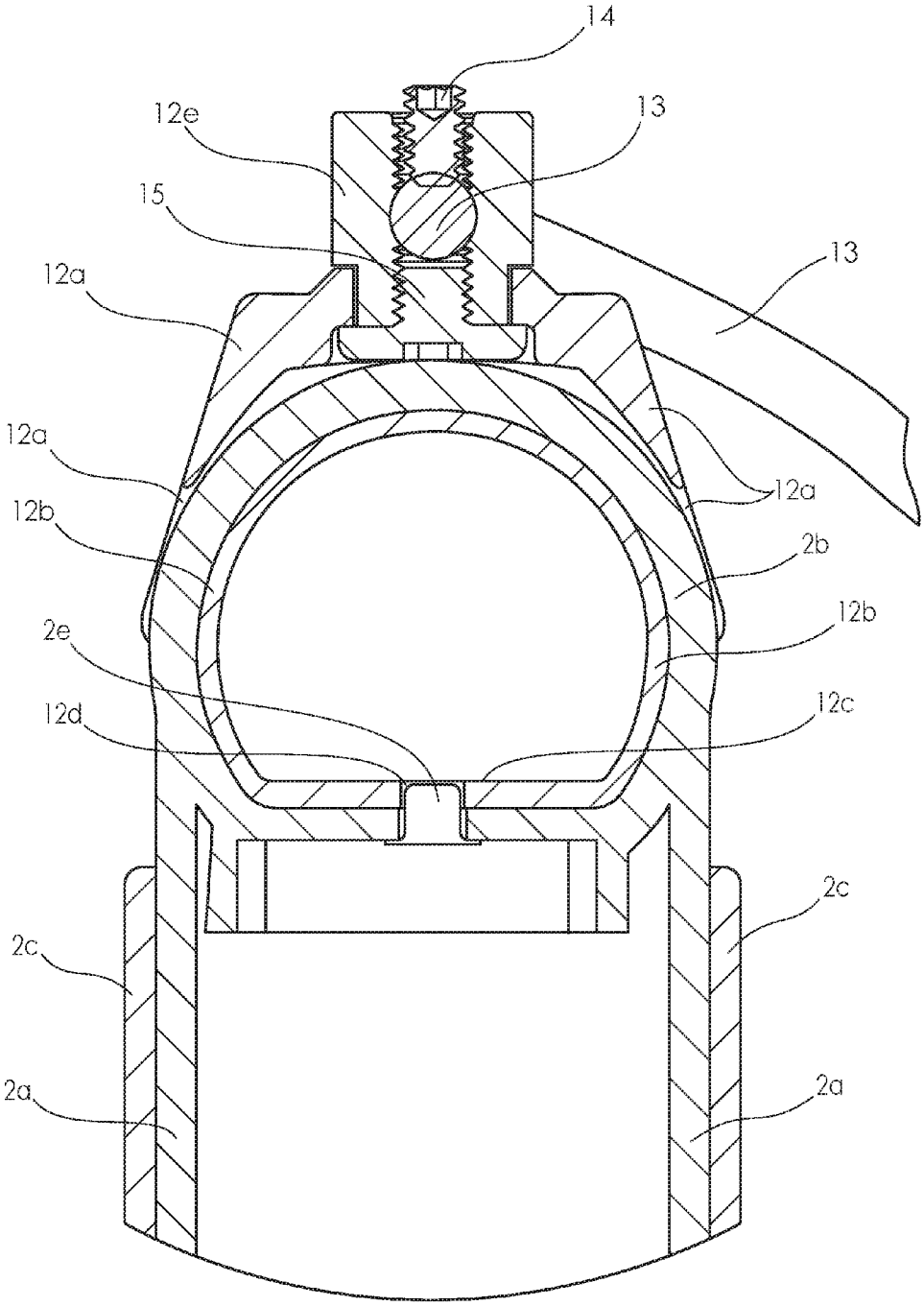
FIG. 14 is a section view of the jump rope release taken at the section line shown in FIG. 13.

FIG. 13 is a perspective view of the jump rope assembly shown attached to the distal end of the handle, and FIG. 14 is a section view of the jump rope release taken at the section line shown in FIG. 13. To release the jump rope assembly 12 from the handle 2, the user would press the handle release button 2*d*, which depresses button 2*e*, thereby allowing the insert member 12*c* to be slid off of the attachment member 2*b*.

The jump rope cable 13 is secured within the cable housing 12*e* with a set screw 14. A socket cap screw 15 is situated within a central recess in the ceiling of the housing 12*a* and screws into the bottom end of the cable housing 12*e*, thereby securing the cable housing 12*e* to the housing 12*a*. Note that a portion of the ceiling of the housing 12*a* extends over the top of the head of the socket cap screw 15, thereby preventing the screw (and the cable housing 12*e*) from falling out of the housing 12*a*. The entire assembly of the cable housing 12*e*, set screw 14, cable 13, and socket cap screw 15 are able to rotate clockwise and counterclockwise relative to the outer surface of the ceiling of the housing 12*a* (see arrows in FIG. 12).

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

REFERENCES

1. Booth, Frank W. et al., *Lack of exercise is a major cause of chronic, diseases*, Compr. Physiol. 2012 April; 2(2): 1143-1211.
2. Centers for Disease Control and Prevention, U.S. Dep't of Health and Human Services, *Preventing Chronic Disease: Eliminating the Leading Preventable Causes of Premature Death and Disability in the United States* (http://www.cdc.gov/chronicdisease/pdf/preventing-chronic-disease-508.pdf).
3. Office of Disease Prevention and Health Promotion, U.S. Dep't of Health and Human Services, Physical Activities Guidelines, Chapter 2 (http://health.gov/paguidelines/guidelines/chapter2.aspx).
4. CBS News, CDC. 80 *percent of American adults don't get recommended exercise*, May 3, 2013 (http://www.cbsnews.com/news/cdc-80-percent-of-american-adults-dont-get-recommended-exercise/).
5. WebMD, *Top 6 Exercise Excuses and How To Beat Them* (http://www.webmd.com/fitness-exercise/guide/the-top-6-exercise-excuses-and-how-to-beat-them?page=2).
6. Centers for Disease Control and Prevention, U.S. Dep't of Health and Human Services, *Overcoming Barriers to Physical Activity* (http://www.cdc.gov/physicalactivity/basics/adding-pa/barriers.html).

We claim:

1. A portable exercise device comprising:

(a) a cylindrical and elongated main shaft with a first end and a second end; and (b) a plurality of central components that fit over the main shaft, each of the plurality of central components comprising a central bore through which the main shaft extends;

wherein the first end of the main shaft is releasably attached to a first handle, and the second end of the main shaft is releasably attached to a second handle;

wherein each of the first and second handles comprises a grip section that is cylindrical in shape and that overlies a handle support with a flat portion;

wherein the grip section of each of the first and second handles is releasably attached to the handle support;

wherein the handle supports are releasably attached to the main shaft;

wherein the main shaft has a longitudinal axis, the first and second handles each has a longitudinal axis, and the longitudinal axes of the main shaft and handles are collinear;

wherein each of the first and second handles comprises an attachment member that extends from a distal end of the handle along the longitudinal axis of the handle and forms an arc;

wherein an inner circumference of the attachment member is circular except for a flat portion that is equal in width to the flat portion of the handle support, and wherein the flat portion of the inner circumference of the attachment member is situated between the grip section of the handle and a top end of the arc formed by the attachment member; and wherein the attachment members of the handles are configured to releasably attach to the handle supports.

2. The portable exercise device of claim 1, wherein the plurality of central components are smooth rollers.

3. The portable exercise device of claim 1, wherein the plurality of central components are trigger point massage rollers having outwardly extending protrusions.

4. The portable exercise device of claim 1, wherein the plurality of central components includes at least one wheel.

5. The portable exercise device of claim 1, wherein the grip section of each of the first and second handles is covered by a rubber material.

6. The portable exercise device of claim 1, wherein the grip section and attachment member of each of the first and second handles are manufactured from a single piece of metal.

7. The portable exercise device of claim 1, wherein the main shaft has a main section with an outer diameter, and wherein the main shaft comprises a protrusion on either end of the main shaft, the protrusion having an outer diameter that is less than an outer diameter of the main section of the main shaft.

8. The portable exercise device of claim 1, wherein the flat portion of the handle support extends from a distal end of the handle support to a point that terminates short of a proximal end of the handle support.

9. The portable exercise device of claim 1, wherein the flat portion of the handle support comprises a plurality of holes that are aligned along a longitudinal axis of the handle support.

10. The portable exercise device of claim 1, further comprising a first foot pad and a second foot pad;

wherein each of the first and second foot pads is releasably attached to the handle support;

wherein each of the first and second foot pads comprises a base plate and a strap that is attached to the base plate and that is configured to allow a person to insert his or her foot between the strap and the base plate;

wherein each of the first and second foot pads further comprises an attachment member that extends outwardly from a bottom surface of the base plate and forms an arc; and wherein an inner circumference of the foot pad attachment member is circular except for a flat portion that is equal in width to the flat portion of the handle support.

11. The portable exercise device of claim 10, wherein the strap extends from left to right of the foot pad and is situated closer to a bottom end of the foot pad than a top end.

12. The portable exercise device of claim 1, further comprising a jump rope assembly that is releasably attached to the handle support;

wherein the jump rope assembly comprises a housing an insert member that is attached to an inner wall of the housing;

wherein the insert member is arc-shaped except for a flat portion;

wherein there is a gap between an outer surface of the insert member opposite the flat portion and an underside of a ceiling of the housing, and wherein the gap is configured to enclose at least a portion of the attachment member of the handle;

wherein the insert member is releasably attached to the attachment member of the handle;

wherein a cable housing is attached to an outer surface of the ceiling of the housing and is configured to accept and secure a jump rope cable; and wherein the jump rope cable is configured to rotate within the relative to the outer surface of the ceiling of the housing.

13. A portable exercise device comprising:

(a) a cylindrical and elongated main shaft with a first end and a second end; and (b) a plurality of central components that fit over the main shaft, each of the plurality of central components comprising a central bore through which the main shaft extends;

wherein the first end of the main shaft is releasably attached to a first handle, and the second end of the main shaft is releasably attached to a second handle;

wherein each of the first and second handles comprises a grip section that is cylindrical in shape and that overlies a handle support;

wherein the grip section of each of the first and second handles is releasably attached to the handle support;

wherein the handle supports are releasably attached to the main shaft;

wherein the main shaft has a longitudinal axis, the first and second handles each has a longitudinal axis, and the longitudinal axes of the main shaft and handles are collinear;

wherein each of the first and second handles comprises an attachment member that extends from a distal end of the handle along the longitudinal axis of the handle and forms an arc;

wherein an inner circumference of the attachment member is circular; and wherein the attachment members of the handles are configured to releasably attach to the handle supports.

* * * * *